US012618647B2

(12) United States Patent
Rutkiewicz

(10) Patent No.: US 12,618,647 B2
(45) Date of Patent: May 5, 2026

(54) LASER PULSE SHAPE DETECTION USING FREQUENCY CHARACTERIZATION

(71) Applicant: Simmonds Precision Products, Inc., Vergennes, VT (US)

(72) Inventor: Robert D. Rutkiewicz, Edina, MN (US)

(73) Assignee: Simmonds Precision Products, Inc., Vergennes, VT (US)

( * ) Notice: Subject to any disclaimer, the term of this patent is extended or adjusted under 35 U.S.C. 154(b) by 231 days.

(21) Appl. No.: 18/111,123

(22) Filed: Feb. 17, 2023

(65) Prior Publication Data

US 2024/0280349 A1 Aug. 22, 2024

(51) Int. Cl.
*F41G 7/22* (2006.01)

(52) U.S. Cl.
CPC ..... *F41G 7/226* (2013.01); *F41G 7/2293* (2013.01)

(58) Field of Classification Search
CPC ..... F41G 7/226; F41G 7/2293; F41G 7/008; F41G 7/2253; G01S 3/784
See application file for complete search history.

(56) References Cited

U.S. PATENT DOCUMENTS

| | | | | |
|---|---|---|---|---|
| 8,581,168 | B2 | 11/2013 | Linder et al. | |
| 9,335,414 | B2 | 5/2016 | Leyva | |
| 9,568,583 | B2 | 2/2017 | Caplan | |
| 9,698,182 | B2 | 7/2017 | Lin et al. | |
| 9,769,400 | B2 | 9/2017 | Lin et al. | |
| 9,857,145 | B1 | 1/2018 | Rutkiewicz et al. | |
| 9,912,302 | B2 | 3/2018 | Lin et al. | |
| 9,948,880 | B2 | 4/2018 | Lund et al. | |
| 10,267,902 | B2 | 4/2019 | Liobe et al. | |
| 10,690,448 | B2 | 6/2020 | Titus | |
| 11,460,272 | B1 | 10/2022 | Frey, Jr. | |
| 11,726,187 | B2 * | 8/2023 | Yin | G01S 7/4865 356/4.01 |
| 2012/0305786 | A1 * | 12/2012 | Dierickx | H04N 25/773 250/371 |
| 2014/0312161 | A1 | 10/2014 | Ell | |

(Continued)

FOREIGN PATENT DOCUMENTS

KR 102256611 B1 5/2021

OTHER PUBLICATIONS

Extended European Search Report for European Patent Application No. 24156820.3, Dated Jul. 8, 2024, 7 Pages.

*Primary Examiner* — Rami Khatib
(74) *Attorney, Agent, or Firm* — Kinney & Lange, P.A.

(57) ABSTRACT

A method includes receiving a plurality of laser pulses as a pulse train on a plurality of imaging sensor pixels in an array of pixels. For each pixel in the array of pixels, the method includes receiving a respective one of the laser pulse trains, and scanning the pixels response across a range of frequencies with a bandpass filter to determine pulse shape characteristics of the respective one of the laser pulse trains. The method includes filtering out all of the laser pulse trains that do not fit a predetermined pulse shape characteristic for a true target designation pulse train, and physically adjusting trajectory of a physical resource toward a target based on location on the imaging sensor of one or more pixels receiving a laser pulse train that fits the predetermined pulse shape characteristic for the true target designation pulse train.

11 Claims, 6 Drawing Sheets

(56) References Cited

U.S. PATENT DOCUMENTS

| | | | | |
|---|---|---|---|---|
| 2014/0374533 | A1* | 12/2014 | Ell | F41G 9/00 244/3.15 |
| 2016/0054434 | A1* | 2/2016 | Williams | G01S 7/4865 356/5.01 |
| 2018/0299535 | A1* | 10/2018 | Jew | G01S 7/4863 |
| 2019/0113605 | A1* | 4/2019 | Liobe | H04N 25/77 |
| 2021/0227158 | A1* | 7/2021 | Kennedy | F41G 7/008 |

* cited by examiner

LASER PULSE SHAPE DETECTION USING FREQUENCY CHARACTERIZATION

BACKGROUND

1. Field

The present disclosure relates to laser pulse detection, and more particularly to laser pulse detection such as for use in laser designation and laser guidance for guided munitions or the like.

2. Description of Related Art

Typical laser targeting systems use timing to differentiate between a laser designator reflection pulses reflected from an intended target, and laser decoy or confuser pulses, similar to the timing used in LIDAR systems. Additionally, there can be scattered reflections of the designator laser that are from the target's environment, and the tracking system must be able to distinguish between the true intended reflection from the designated target and the scattered environmental reflections of the designator laser.

Typical semi-active laser (SAL) tracking systems use high time resolution, on the order of 100 MHz, to characterize the pulse shape of received signals to help filter out environmental reflection of the designator laser as well as filtering out decoy or confuser pulses. However, typical SAL tracking systems do not provide images of the target or its environs.

SWIR (short wave infrared) imaging sensors can be used in trackers to provide images of the target and its environs, and can be used for pulse detection within the sensor's field of view. But the typical SWIR sensor does not have the capability to achieve the 100 MHz time resolution needed to distinguish pulse shapes.

There is a need to differentiate laser pulse returns without high-speed time resolution, e.g. for SWIR imaging sensors. For instance, something equivalent to about 10 nanosecond time resolution and about 10 feet (3.048 meters) spatial resolution is needed.

The conventional techniques have been considered satisfactory for their intended purpose. However, there is an ever present need for improved systems and methods for improved laser pulse detection and discrimination. This disclosure provides a solution for this need.

SUMMARY

A method includes receiving a plurality of laser pulse data from multiple light pulses as a capture from points in space having different pulse shapes and intensities returned from a designator pulse train onto a plurality of imaging sensor pixels in an array of pixels. For each pixel in the array of pixels over time receiving a light pulse, the method includes scanning over time a center frequency of a bandpass filter to determine a frequency signature corresponding to pulse shape characteristics reflecting from different objects and surfaces. The method includes filtering out all of the pixels with pulse data that do not fit a predetermined frequency signature corresponding to pulse shape characteristic for a true target designation laser pulse return capture. One or more pixels that are not filtered out, which do fit the pulse shape characteristic for the true target designation light pulse return capture, are designated as target return pixels. The method includes physically adjusting trajectory of a physical resource toward a target based on location on the imaging sensor of the target return pixels.

The method can include, in addition to scanning the center frequency of a bandpass filter, setting a minimum pulse size threshold for each pixel in the array of pixels. Determining a frequency signature can include applying the minimum pulse size threshold together with using frequency data from pixel response of changing the frequencies setting of a bandpass filter. Determining a frequency signature can include determining rising edge speed, pulse width, and/or pulse height.

The method can include generating image data using the imaging pixels in the array of pixels, and using the image data to help discriminate between true target designation light pulse shapes and false light pulse shapes for physically adjusting trajectory of the physical resource. The method can include for the target return pixels, using detection timing to lock into a pulse repetition frequency (PFR) of the true target designation pulse train. Receiving a plurality of laser pulse data can be performed at a frequency on the order of 1 KHz. Scanning over time can include changing the center frequency of the bandpass filter for each subsequent pulse within the laser pulse train. The method can include providing pulse frequency signature data corresponding to shape data, pulse intensity data, and pulse spatial location data for physically adjusting trajectory of the physical resource toward the target.

A system includes an imaging sensor with a two-dimensional array of pixels. A read out integrated circuit (ROIC) including pulse detection logic and an image capture logic is operatively connected to the array of pixels for pulse detection and imaging capture. A processor is operatively connected to the ROIC. The processor includes machine readable instructions configured to cause the processor to:

- control settings of the ROIC to globally change the pulse detection intensity and pulse bandpass frequencies for each pixel in the array of pixels receiving a laser pulse data, and scanning pixel detection responses across a range of frequencies with a bandpass filter to generate pulse train data;
- determine pulse shape characteristics using the pulse train data;
- filter out laser pulse signatures from the array of pixels that do not fit a predetermined pulse shape characteristic for a true target designation pulse; and
- output control signals for physically adjusting trajectory of a physical resource toward a target based on location on the imaging sensor of one or more pixels receiving a laser pulse train that fits the predetermined pulse shape characteristic for the true target designation pulse train.

The system can include the physical resource, wherein the imaging senor, the ROIC, and the processor are onboard the physical resource. Optics can be included and aligned to focus images of a scene and laser pulse trains onto the array of pixels. The machine readable instructions can be configured to cause the processor to set ROIC configuration to change pixel detection conditions for pulse trains and image capture settings. The machine readable instructions can be configured to cause the processor to read in detection data from the ROIC for images and pulse trains. The machine readable instructions can be configured to cause the processor to align pixel pulse detection data with the ROIC configuration to characterize detected pulse trains.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
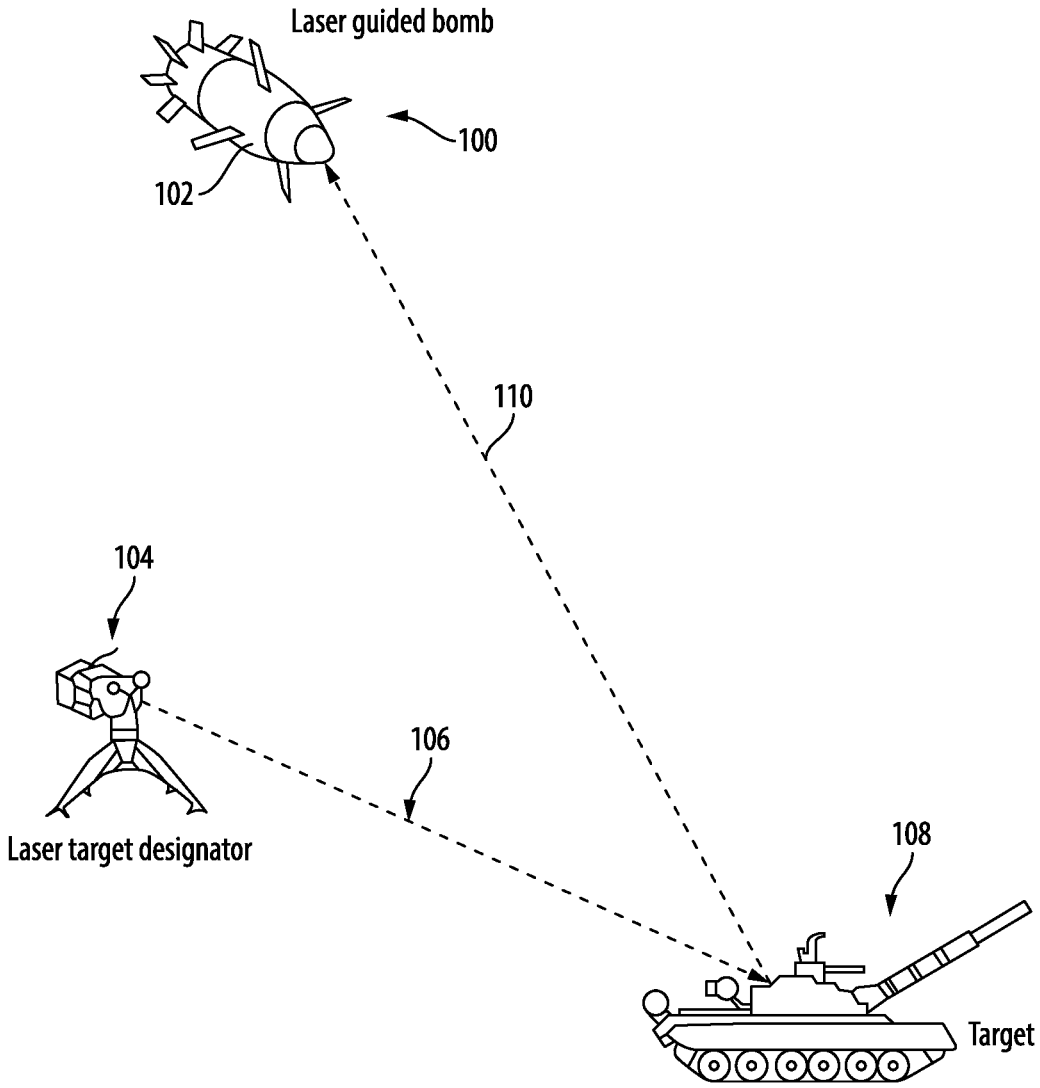
FIG. 1 is a schematic perspective view of an embodiment of a system constructed in accordance with the present disclosure, showing use of the system in laser designation and detection.

Reference will now be made to the drawings wherein like reference numerals identify similar structural features or aspects of the subject disclosure. For purposes of explanation and illustration, and not limitation, a partial view of an embodiment of a system in accordance with the disclosure is shown in FIG. 1 and is designated generally by reference character 100. Other embodiments of systems in accordance with the disclosure, or aspects thereof, are provided in FIGS. 2-6, as will be described. The systems and methods described herein can be used to determine laser pulse shapes for discriminating desired laser pulse designations from undesired laser pulses, using relatively low time resolution, e.g. on the order of 1 KHz rather than on the order of 100 MHz.

The system 100 can be onboard a physical resource, which can be any suitable moving platform such as an aircraft or guided munition 102. A laser designator 104, which can be aboard the same moving platform as system 100, or can be on a separate platform such as the forward observer shown in FIG. 1, on another vehicle, or the like, directs laser illumination 106 to a target 108. A return or reflection 110 of the laser illumination 106 can be detected by system 100, which can be used to guide the physical recourse, e.g. the guided munition 102, to the target 108.

Figure 2:
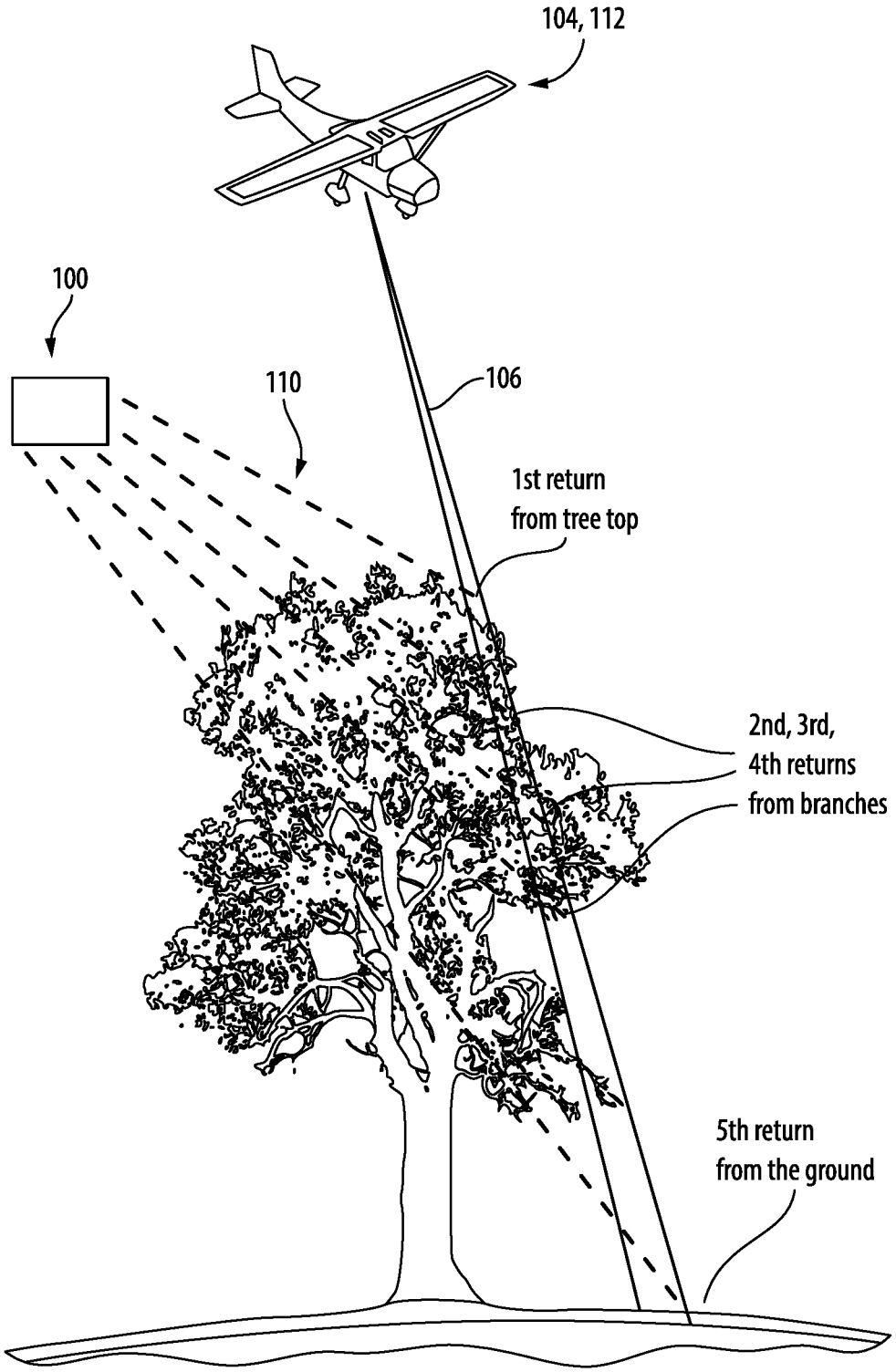
FIG. 2 is a schematic perspective view of an embodiment of a system constructed in accordance with the present invention, showing false reflections from the laser designator.

With reference to FIG. 2, the laser designator 104 is depicted as aboard an aircraft 112. The environs of the laser illumination 106 cause the beam to spread and reflect off of multiple surfaces, causing multiple returns to be visible to the system 100, as indicated in FIG. 2 by the dashed lines. The system 100 needs to be able to track the correct target, despite the potential for the multiple returns from the laser illumination 106, and despite any counter measures deployed in the vicinity, e.g. with decoy or confuser illumination.

Figure 3:
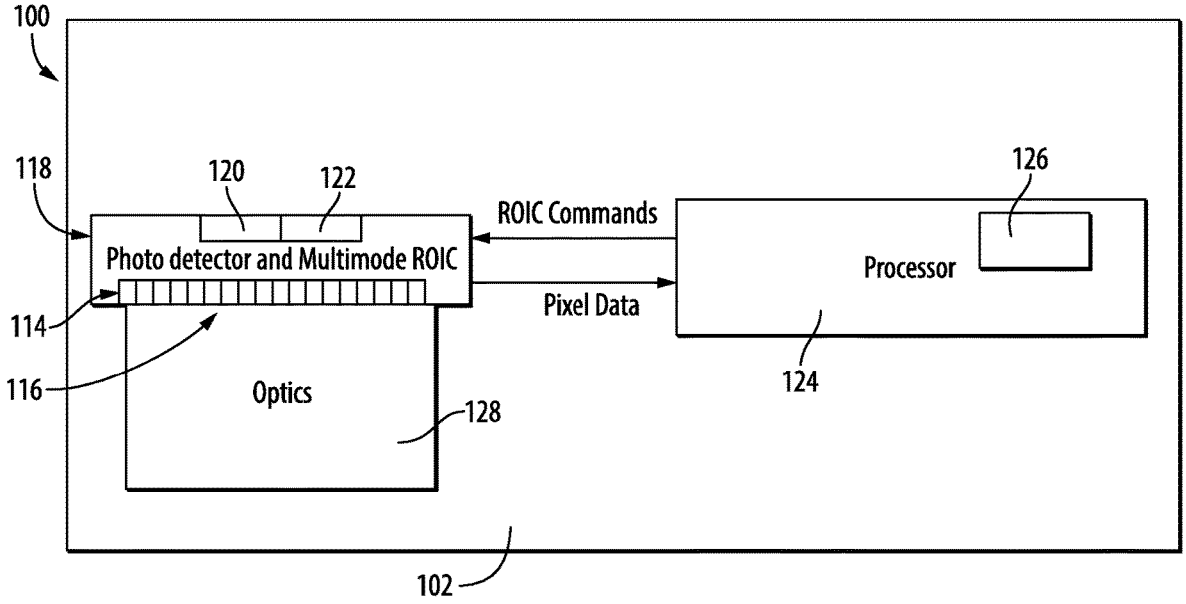
FIG. 3 is a schematic view of the system of FIG. 1, showing the connection of the processor and the imaging sensor and read out integrated circuit (ROIC)

With reference now to FIG. 3, the system 100 includes an imaging sensor 104 with a two-dimensional array of pixels 116 which is facing downward as oriented in FIG. 3. A read out integrated circuit (ROIC) 118 including pulse detection logic 120 and an image capture logic 122 is operatively connected to the array of pixels 116 for pulse detection and imaging capture. The photodetector pixels 116 convert light into electrical energy, which the ROIC 118 amplifies and detects. The pixels 116 can be sensitive to short wave infrared (SWIR) illumination. A processor 124 is operatively connected to the ROIC 118 to provide commands to the ROIC 118, and to receive the pixel data from the ROIC 118, as indicated by the arrows in FIG. 3. The processor 124 includes machine readable instructions 126, such as digital code, dedicated logic circuits, analog circuits, or the like. The machine readable instructions are to cause the processor to implement methods as described further below.

With continued reference to FIG. 3, the system 100 includes the physical resource 102, wherein the imaging senor 114, the ROIC 118, and the processor 124 are onboard the physical resource 102, e.g. a moving platform. The system 100 can include optics 128 aligned to focus images of a scene, e.g. the scenes shown in FIGS. 1-2, and laser pulse trains, e.g. from the laser returns shown in FIGS. 1-2, onto the array of pixels 116.

Figure 4:
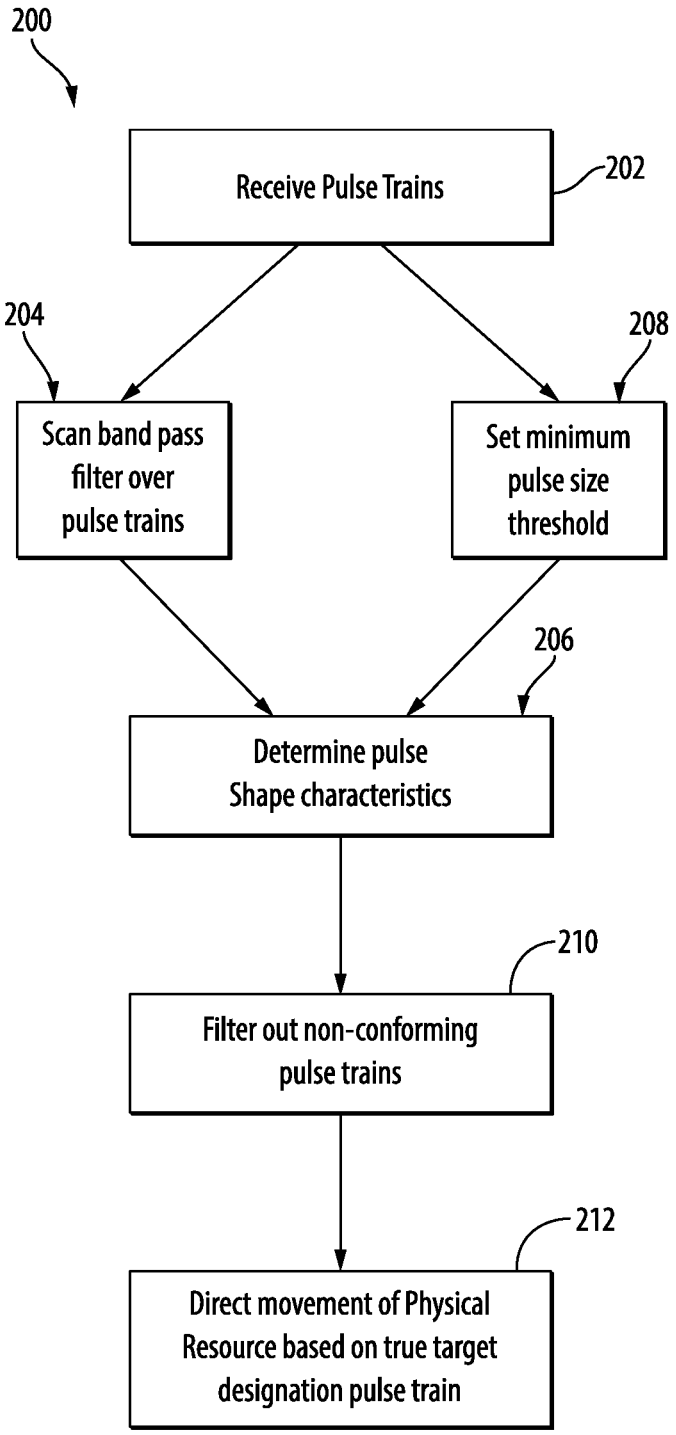
FIG. 4 is a flow diagram of a method used by the system of FIG. 1, showing a process for discriminating laser pulse trains.

With reference now to FIG. 4, a process is provided for using the ROIC 118 and processor 124 described above with reference to FIG. 3. A method 200 includes receiving a plurality of laser pulse trains on the plurality of imaging sensor pixels in an array of pixels 116 (labeled in FIG. 3), as indicated by box 202. For each pixel 116 in the array of pixels 116 (labeled in FIG. 3), the method 200 includes receiving the respective one of the laser pulse trains into the ROIC 118 (labeled in FIG. 3), which scans the signal from the pixel across a range of frequencies with a bandpass filter, watching for falloff, as indicated by box 204 to determine pulse shape characteristics of the respective one of the laser pulse trains, as indicated by box 206.

The method 200 includes, in addition to scanning the signal with the bandpass filter, for each pixel in the array of pixels, setting a minimum pulse size threshold, as indicated by box 208. Determining pulse shape characteristics of the respective one of the laser pulse trains, indicated by box 206, includes applying the minimum pulse size threshold together with using data from scanning the signal from the pixel across a range of frequencies with a bandpass filter. Determining pulse shape characteristics includes determining rising edge speed, pulse width, and/or pulse height.

The method 200 includes filtering out data from the processor 124 (labeled in FIG. 3) for all of the laser pulse trains that do not fit a predetermined pulse shape characteristic for a true target designation pulse train, as indicated by box 210. The processor 124 can output control signals, e.g. for actuators, to physically adjust trajectory of a physical resource toward a target based on location on the imaging sensor of one or more pixels 116 receiving a laser pulse train that fits the predetermined pulse shape characteristic for the true target designation pulse train, as indicated by box 212.

The method can include generating image data using the imaging pixels in the array of pixels, and using the image data to help discriminate, e.g. at box 210, between the true target designation pulse train and false pulse trains for physically adjusting trajectory of the physical resource. For the one or more pixels, the method can include receiving a laser pulse train that fits the predetermined pulse shape characteristic for the true target designation pulse train, and using detection timing in the ROIC 118 and/or processor 124 (labeled in FIG. 3) to lock into a pulse repetition frequency (PFR) of the true target designation pulse train.

Receiving a plurality of laser pulse trains on a plurality of imaging sensor pixels in an array of pixels can be performed at a frequency on the order of 1 KHz, which is too slow for direct temporal resolution of pulse shape, which is on the order of 100 MHz. Scanning a signal from each pixel across a range of frequencies with a bandpass filter can include changing the center frequency of the bandpass filter for each subsequent pulse in the respective one of the laser pulse trains. The method can include providing pulse shape data, pulse intensity data, and pulse spatial location data for physically adjusting trajectory of the physical resource toward the target.

The method directly measures the frequency content of the pulses. Time domain pulse shapes have a corresponding frequency content generated using Fourier Transforms methods. These transforms convert data between time and frequency domain. The pulse shape in the time domain is transformed into the frequency domain. The transform can be computed in real time or stored in memory from previous calculation of the transform output. Real time conversion to frequency domain is useful when a pulse shape is provided to the system. One technique is to store frequency content data as a known good frequency signature and work in the frequency domain for true target laser pulse shapes. Reducing need for computation resources is typical for such systems.

Figure 5:
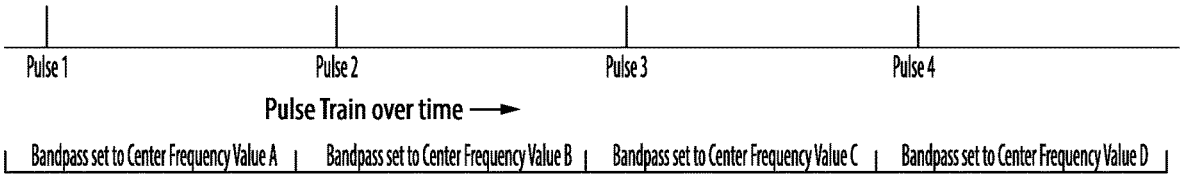
FIG. 5 is a diagram that shows the alignment of the bandpass filter settings to the pulses for a laser pulse train.
Figure 6:
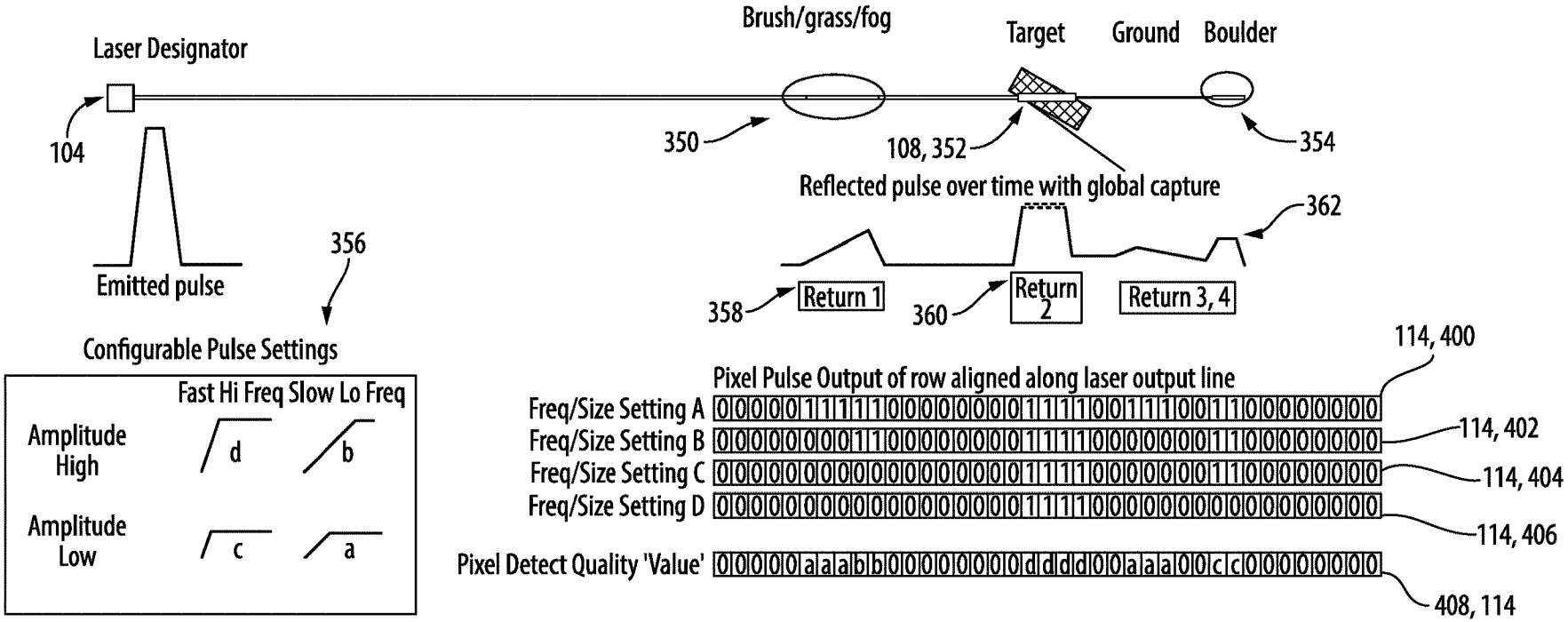
FIG. 6 is a diagram that shows how the correspondence of scanning the pixel pulse setting creates a frequency signatures for pulse shape on each pixel.

With continued reference to FIGS. 3 and 4, the processor 124 includes machine readable instructions 126 configured to cause the processor 124 to control settings of the ROIC 118 to change the pulse intensity and pulse bandpass center frequencies for the array of pixels 116 that are receiving a laser pulse train. The ROIC is set to a specific center frequency for the duration of time between pulses, as indicated in FIG. 5. This is the duration of the inverse of the pulse repetition frequency (PRF). The processor scans by changing the center frequency of the bandpass between each pulse capture in the pulse train. Changing the frequency changes the detection response of pixels to the pulse. In FIG. 5, Pulse 1 capture uses center frequency A. Pulse 2 capture uses center frequency B and so on until all frequencies of the scan are used. Over a set of laser pulse returns in the pulse train, the center frequency is scanned across the frequency domain. The change in the center frequency over multiple pulse captures the pulse shape in the frequency domain. FIG. 6 shows how it takes multiple pulse captures from the pulse train before a complete signature for a given object 350, 352, 354 is known. This method uses the assumption of successive pulses having the same pulse shape 356 over the relatively few successive pulses. The frequency data from the same object 350, 352, 354 over time may come from the same pixel or different pixels that have been processed to be aligned by the processor 124 (labeled in FIG. 3) to correspond to the same object 350, 352, 354. In FIG. 6, each object 350, 352, 354 has its own laser pulse return frequency signature 358, 360, 362. The processor 124 (labeled in FIG. 3) can determine pulse shape characteristics using the pulse train data, as indicted in box 206 of FIG. 4, and can filter out, e.g., ignore, all of laser frequency signatures from the array of pixels 116 (labeled in FIG. 3) that do not fit a predetermined pulse shape characteristic 356 for a true target designation pulse shape, as indicated in box 201 of FIG. 4. The pulse shape characteristic 356 in FIG. 6 that corresponds to the true target designation is designated d, as opposed to a, b, c. The processor 124 ranks the frequency signatures of the different objects 350, 352, 354 to determine the intended return from non-target pulse returns 358, 362. The frequency signatures change as the distance changes and the laser light previously captured in one or two pixels is spread out into more pixels. The processor 124 (labeled in FIG. 3) can optimize the center frequency scanning to reduce the time for frequency signature updates. The processor can output control signals for moving a physical resource as explained above and indicated by box 212 of FIG. 4. The scanning occurs in the ROIC setting for frequency over time, with a new setting for each captured pulse data. The pulse train is needed to enable a new capture at the new setting within the scan. FIG. 6 highlights how an initial pulse returning from different objects 350, 352, 354 onto different pixels 114 (labeled in FIG. 1) generates a different signature value a, b, c, d (for example) for the pixels 114 at line 408 in FIG. 6, primarily in the frequency, but also the intensity of the return 358, 360, 362.

FIG. 6 shows how in the pixel array, reflected pulses (returns 350, 352, 354) are captured separately on different pixels 114 with a unique shape occurring at the locations in the pixels 114. For the first frequency/size setting 400, a single high sensitivity setting captures returns in multiple pixels. At a frequency/size setting 402, this changes for some pixels 114. It changes for some pixels 114 again for the frequency/size setting 404. For the fourth frequency/size setting 406, an increasing threshold again reduces the number of pixels 114 that detect pulses. Taking the responses of the pixels 114 for all of the frequency/size settings 400, 402, 404, 406 in to account, the processor 114 of FIG. 3 can classify the pulse detections to the expected shapes 356 (e.g. shapes a, b, c, d), looking for contiguous pixels 114 with the same high intensity pulse shape d as indicative of the actual target 108.

With reference again to FIG. 4, The machine readable instructions 126 can be configured to cause the processor 124 to set the configuration of the ROIC 118 to change detection conditions of each pulse within the pulse trains, and image capture settings. The machine readable instructions 126 can be configured to cause the processor 124 to read in detection data from the ROIC 118 for both images and pulse data. The machine readable instructions can be configured to cause the processor 124 to align pixel pulse detection data with the ROIC configuration to characterize detected pulse trains, e.g. to assist in guiding the physical resource to its target.

The data for each pixel is a vector value of the output at the different pulse magnitude and bandpass center frequencies. These that can be merged into a single value metric or can be maintained as a vector value providing a means to track the change in frequency signature corresponding to the pulse signature over time. This additional temporal processing is used to track if the reflections are changing as expected by spreading out or if they are a spoof or fake pulse. The processor 124 can change the ROIC settings for capturing new pixel response data and merge the multiple pulse results of each pixel 116. This can also determine the minimum setting for pulse detection at each pixel 116. The processor 124 may have to track motions from the seeker, e.g. as the imaging sensor 114 pans across a scene. The image channel allows for image registration to compensate for motions.

The processor can set the global pulse detection setting for the array. The intended pulse occurs, some pixels pointing at the target get triggered that a pulse occurred that exceeds the current setting. Multipath and spoofing may trigger other pixels in the array. The binary result of whether a pixel is triggered or not is saved for the current pulse detection setting. After a duration corresponding to the time between pulses, the ROIC thresholds is configured to a new setting for bandpass filter and pulse strength. The pixels pulse detected or not detected data is again captured for all pixels for the current setting. The ROIC setting is changed again for the next expected pulse occurrence and pixel new detection datum is captured. Once all the ROIC setting have been used to cover the frequency range, the pixel data is processed. The pulse detection data from the multiple pulses is combined to characterize the pulse shape by noting if specific settings were triggered or not. Optimization for the ROIC setting to use and the order for applying the settings, subdividing the frames, e.g. captured at 1000 Hz, within each setting, checking PRF, and the like, can be used for dynamically enhancing system performance. The ROIC settings for the pixels and if the light pulse is detected or not, are dependent on the frequency/pulse shape of the light pulse impinging on the specific pixel.

Systems and methods as disclosed herein provide potential benefits including the following. They provide a new type of pulse characterization data using existing hardware capabilities of the SWIR dual mode sensor. The pulse characterization allows the SWIR dual mode sensor to have the added functionality of a semi-active laser (SAL) seeker. The systems and methods disclosed herein add the ability to perform new pulse data characterization. This laser pulse characterization is intended to be equivalent and better than direct measure of pulse timing.

The methods and systems of the present disclosure, as described above and shown in the drawings, provide for determining laser pulse shapes for discriminating desired laser pulse designations from undesired laser pulses, using relatively low time resolution, e.g. on the order of 1 KHz rather than on the order of 100 MHz. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A method comprising:

determining a pulse repetition frequency (PRF) of a train of pulses generated by a laser designator;

coordinating a capture of a sequence of images with the PRF so as to capture a single pulse of the train of pulses within each of the sequence of images captured, the images captured, via an imaging sensor with a two-dimensional array of pixels, each located at a corresponding pixel location within the two-dimensional array of pixels;

globally configuring band-pass filtering, by an ROIC, of temporal signals generated by each of the two-dimensional array of pixels for each of the sequence of images captured, thereby generating filtered pulse data;

determining a temporal pulse shape corresponding to each of the two-dimensional array of pixels using the filtered pulse data obtained for the sequence of images captured;

identifying one or more pixels the two-dimensional array of pixels corresponding to a predetermined temporal pulse shape characteristic of a true target; and physically adjusting trajectory of a guided munition toward the true target based on the pixel locations of the one or more pixels having the predetermined temporal pulse shape characteristic of the true target.

2. The method as recited in claim 1, further comprising:

globally configuring intensity thresholding, by the ROIC, of the temporal signals generated by each of the two-dimensional array of pixels during the sequence of images captured.

3. The method as recited in claim 1, further comprising:

reading in the filtered pulse data from the ROIC for each of the sequence of images captured.

4. The method as recited in claim 1, wherein the sequence of images are captured at a frequency on the order of 1 KHz.

5. The method as recited in claim 1, wherein globally configuring band-pass filtering, by an ROIC, of temporal signals generated by each of the two-dimensional array of pixels during the sequence of images captured includes changing a center frequency of the band-pass filtering for each of the sequence of temporal windows of image capture.

6. A system comprising:

an imaging sensor with a two-dimensional array of pixels, each located at a corresponding pixel location within the two-dimensional array of pixels;

a read out integrated circuit (ROIC) including globally configurable band-pass filtering of temporal signals generated by each of the two-dimensional array of pixels during a capture of an image, thereby generating filtered pulse data; and a processor operatively connected to the ROIC, wherein the processor includes machine readable instructions configured to cause the processor to:

control settings of the ROIC to globally configure the band-pass filtering of the temporal signals generated by each of the two-dimensional array of pixels during each of a sequence of images captured, each of the sequence of images captured timed to permit capture of a single pulse of a train of pulses generated by a laser designator;

determine a temporal pulse shape corresponding to each of the two-dimensional array of pixels using the filtered pulse data obtained for the sequence of images captured;

identify one or more pixels of the two-dimensional array of pixels corresponding to a predetermined temporal pulse shape characteristic of a true target; and output control signals for physically adjusting trajectory of a guided munition toward the true target based on the pixel locations of the one or more pixels having the predetermined temporal pulse shape characteristic of the true target.

7. The system as recited in claim 6, further comprising the guided munition, wherein the imaging senor, the ROIC, and the processor are onboard the guided munition.

8. The system as recited in claim 7, further comprising optics aligned to focus images of a scene and laser pulse trains onto the array of pixels.

9. The system as recited in claim 6, wherein the ROIC includes globally configurable intensity thresholding of the temporal signals generated by each of the two-dimensional array of pixels during a temporal window of image capture, and the machine readable instructions are further configured to cause the processor to control settings of the ROIC to globally configure the intensity thresholding of the temporal signals generated by each of the two-dimensional array of pixels during each of a sequence of images captured.

10. The system as recited in claim 9, wherein the machine readable instructions are configured to cause the processor to read in the filtered pulse data from the ROIC for each of the sequence of images captured.

11. The system as recited in claim 10, wherein the machine readable instructions are configured to cause the processor to cause the ROIC to change a center frequency of the band-pass filtering for each of the sequence of images captured.

* * * * *